United States Patent [19]

Powell et al.

[11] 4,354,535

[45] Oct. 19, 1982

[54] HAND-HELD AUTOMATIC WIRE BINDING TOOL

[76] Inventors: Robert Y. Powell, 750 Adams, Memphis, Tenn. 38105; Jeff A. Fisher, 12205 Greenlead Dr., Huntsville, Ala. 35803

[21] Appl. No.: 142,394

[22] Filed: Apr. 21, 1980

[51] Int. Cl.[3] ..... B21F 15/04

[52] U.S. Cl. ..... 140/93 A; 140/93.6; 140/119; 140/149

[58] Field of Search ..... 140/57, 93 A, 93.6, 140/115, 119, 149

[56] References Cited

U.S. PATENT DOCUMENTS

| | | | |
|---|---|---|---|
| 3,211,187 | 10/1965 | Paule et al. | 140/93.6 X |
| 3,368,590 | 2/1968 | Welden | 140/93 A |
| 3,391,715 | 7/1968 | Thompson | 140/93.6 |
| 3,593,759 | 7/1971 | Wooge | 140/93.6 |
| 3,880,204 | 4/1975 | Sarff et al. | 140/93 A |
| 4,117,872 | 10/1978 | Gott et al. | 140/93.6 X |
| 4,177,842 | 12/1979 | Dilley | 140/93.6 |
| 4,178,973 | 12/1979 | Collier et al. | 140/93 A X |

*Primary Examiner*—Howard N. Goldberg
*Assistant Examiner*—Fred A. Silverberg
*Attorney, Agent, or Firm*—Kit M. Stetina

[57] ABSTRACT

A portable tool for enabling a workman (while maintaining a comfortable standing position) to bind a pair of concrete re-enforcement rod structural members (which may be disposed in proximity to the feet of the workman) together by utilizing a supply of wire that is carried on a reel as part of the tool. Disposed adjacent the lower end of the tool is a pair of jaws which are normally open to introduce the structural members into a hole defined by the jaws when closed. The tool is fully automatic and a sequence of binding events is started by depressing a trigger which is disposed adjacent the upper end of the tool. The binding sequence is completed in a few seconds which, of course, enables the workman to accomplish considerably more work than normal.

11 Claims, 16 Drawing Figures

HAND-HELD AUTOMATIC WIRE BINDING TOOL

BACKGROUND OF THE INVENTION

1. Field of the Invention

This invention relates to the field of wire binding tools and is particularly directed towards a tool for applying a wire loop around re-enforcement rods commonly used to re-enforce concrete construction.

2. Description of the Prior Art

Several attempts have been made to provide an acceptable wire binding tool for enabling a workman (from a standing position) to bind a pair of concrete re-enforcement rod structural members (which may be disposed at his feet) together. See for example the Paule et al., U.S. Pat. No. 3,211,187; the Thompson, U.S. Pat. No. 3,391,715; and the Wooge, U.S. Pat. No. 3,593,759. However, none of these above mentioned patents suggest or disclose applicants' device.

The task of manually tying or binding concrete re-enforcement structural rod members together is a very tiring, menial task. Indeed, this task is so strenuous that the workmen usually develop back ailments necessitating job changes. Therefore, the turn over of personnel utilized in accomplishing this task is exceedingly high. Prior attempts to provide an acceptable tool for accomplishing this task have not met with success for reasons unknown. At any rate, the task, by and large, is still being manually accomplished.

SUMMARY OF THE INVENTION

The present invention is directed towards alleviating the necessity of the workman to stoop while accomplishing the task of binding together the re-enforcing rods. In other words, it is believed that if an acceptable tool could be provided whereby the workman could accomplish this task from a standing position he would not suffer the back ailments heretofore experienced in performing this task. Additionally, by utilization of the present invention a given number of re-enforcing rods can be properly tied together in a considerably shorter period of time, which obviously provides a savings in manpower. The concept of the present invention is to provide a tool for remotely binding a pair of concrete re-enforcing rod structural members together in an expeditious manner. The tool (being held upright) includes a pair of jaws disposed adjacent the lower end, which are normally opened to introduce the structural members into a hole defined by the jaws when closed. The tool is fully automatic and a sequence of binding events is started by merely depressing a trigger, which is disposed adjacent the upper end of the tool. The binding sequence is completed in a few seconds. This, of course, enables the workman to accomplish considerably more work then normal. Therefore, it is not only logical to anticipate that the turn over of workmen assigned to this task should decrease considerably by implementation of the present invention, but the cost factor in accomplishment of this task should be greatly reduced.

DESCRIPTION OF THE PREFERRED EMBODIMENT

Figure 3B:
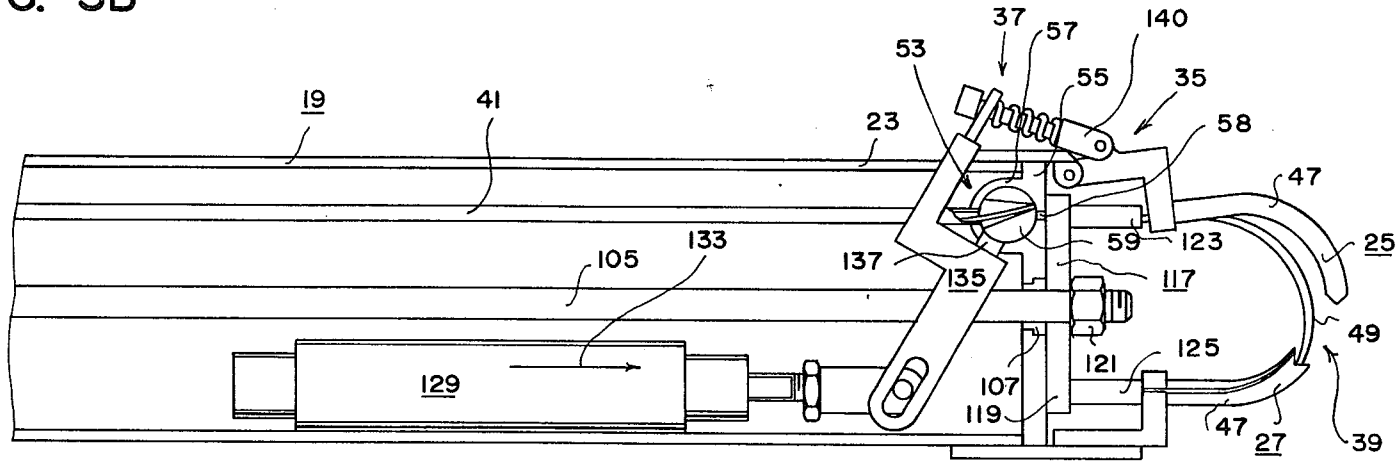
FIGS. 3A and 3B also jointly depict an enlarged view of the tool as shown in FIG. 1—although it is shown therein in a more normal condition, e.g., the jaws are shown opened.
Figure 4:
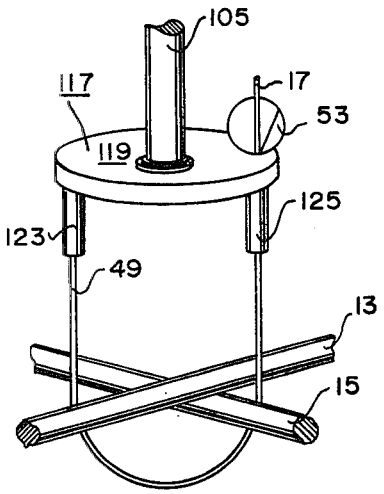
FIG. 4 is a perspective vie of detached structure intended to depict the wire shear means and the wire twist means of the present invention, with a length of wire being shown disposed in an optimum arrangement about a pair of re-enforcing rods.
Figure 5:
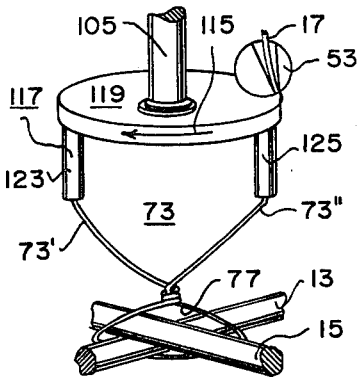
FIG. 5 is a view similar to FIG. 4 of the wire shear and wire twist means with the view taken subsequent to the wire having first been sheared and then twisted about the pair of re-enforcing rods.

The wire binding tool 11 of the present invention is intended for enabling a workman (which will not be shown but will be assumed to be in standing position) to bind together a pair of concrete re-enforcement rod structural members 13, 15, see FIGS. 4 and 5 of the drawings (which may be disposed at the workman's feet) by utilizing a supply of wire characterized by the numeral 17, which is provided in a continuous form. The tool 11 includes a main body member 19, which may simply consist of frame-like structure or if desired it may be in the form of an enclosure. Of course, the main body member 19 does not, of itself, constitute any of the inventive concepts of the tool 11. Therefore, it will be deemed unnecessary to elaborate any further on the main body member 19 other than to simply state that it has upper and lower ends 21, 23 respectively thereto. From FIGS. 1, 2B and 3B of the drawings it may clearly be seen that the tool 11 includes a pair of jaws 25, 27, which are disposed adjacent the lower end 23 and which jointly define in part a hole 29 through which the pair of structural members 13, 15 may freely extend.

The tool 11, being rather long and slender, is positioned with the longitudinal axis thereof substantially vertically disposed while being manually held by the workman. Therefore, the jaws 25, 27 will be positioned somewhat at the workman's feet while the upper end 21 is supported in the hands of the workman as he retains a standing position. The tool 11 includes a handle 31, which is suitably attached to the upper end 21. In addition, the upper end 21 is fitted with a spool 33 for accommodating a continuous length of the wire 17.

Figure 2A:
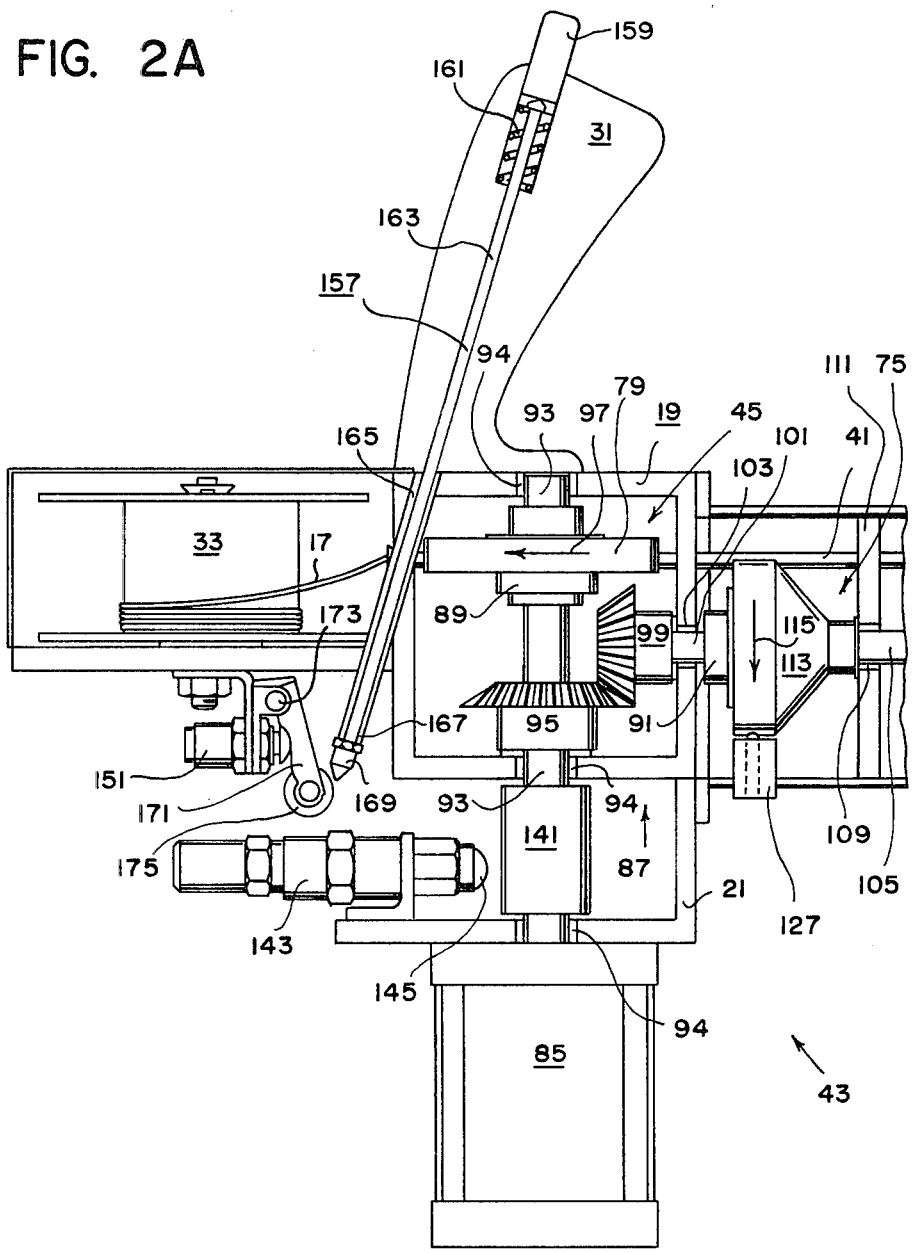
FIGS. 2A and 2B jointly depict an enlarged view of the tool as shown in FIG. 1.
Figure 2B:
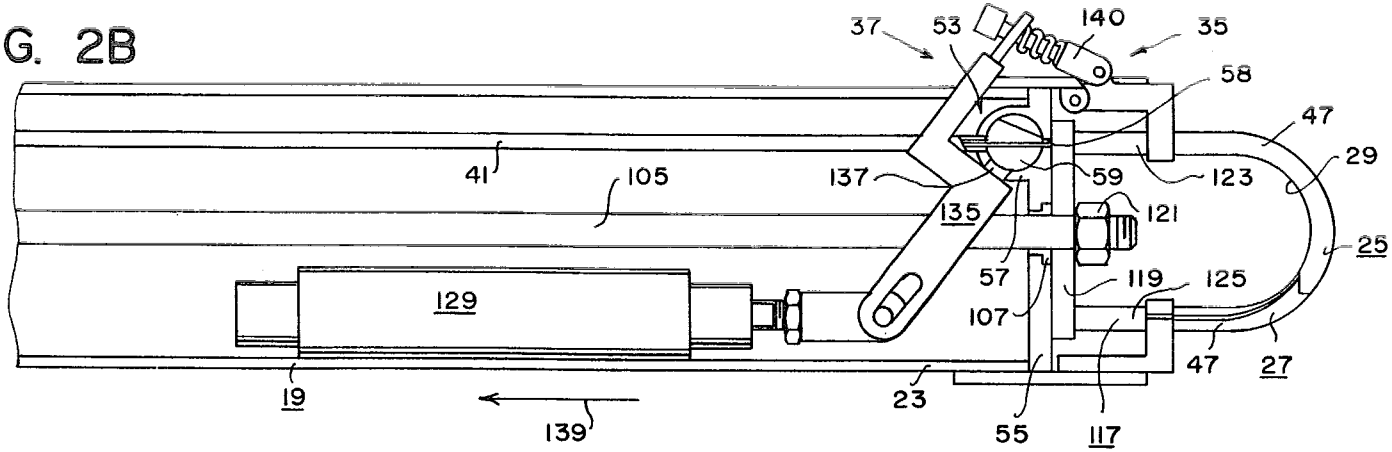

Also, included are means, for example, pivotal linkage means 35 as shown in FIGS. 2B, 3B, for pivotally attaching at least one of the jaws 25, 27, e.g., jaw 25 to the main body member 19. Also, included are jaw operating means, such as a lever arrangement generally characterized by the numeral 37 in FIGS. 2B, 3B. The lever arrangement 37 is coupled to the pivotal jaw 25 in a manner to be described for remotely operating the jaw 25 between a "closed position" as shown in FIG. 2B and a normally "opened position" as shown in FIG. 3B. In this manner, a mouth-like opening, as at 39, is established for enabling the opened jaws 25, 27 to be passed over the medial portions of the structural members 13, 15, thus being admitted to the hole 29, for enabling the wire 17 to be passed around the adjacent structural members 13, 15 and substantially as suggested in FIGS. 4 and 5 of the drawings.

Figure 3A:
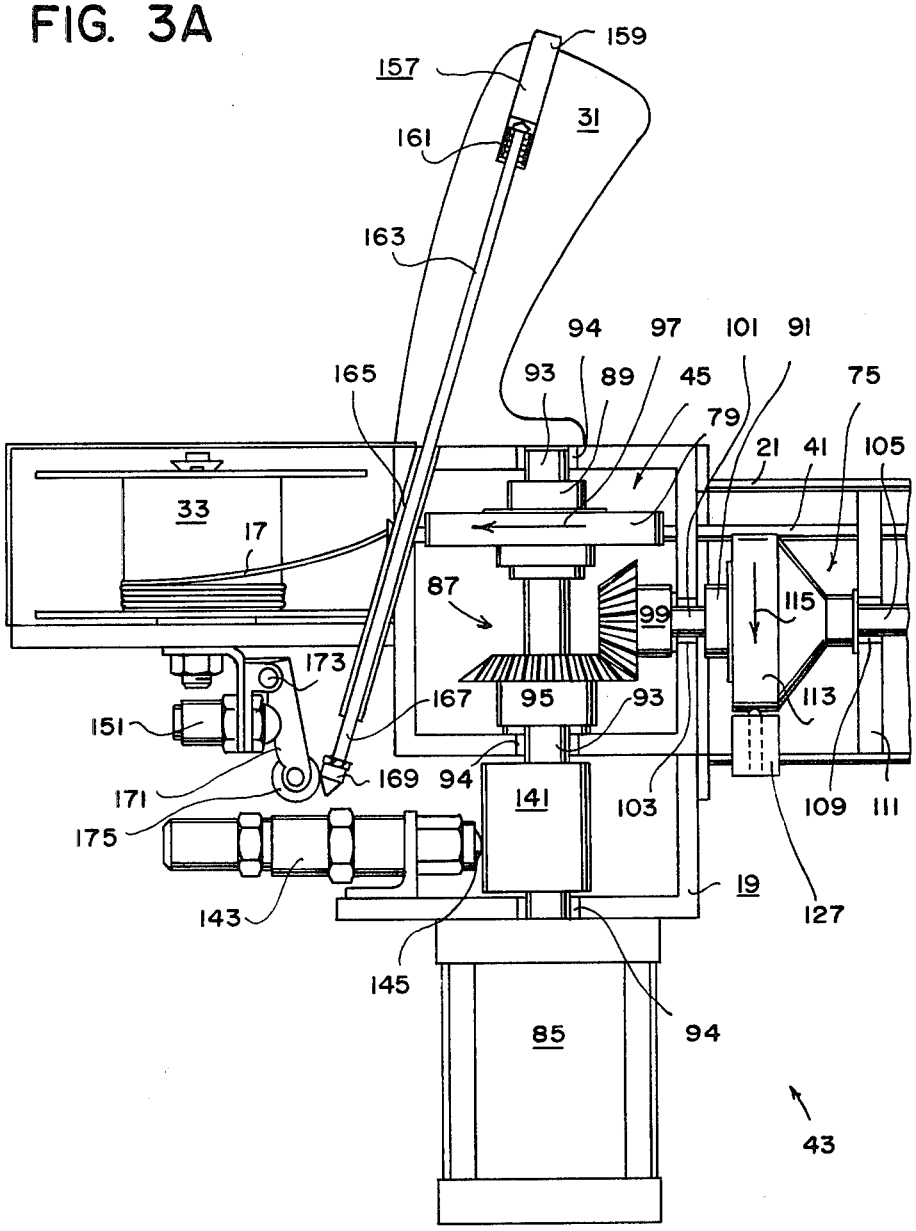
Figure 6:
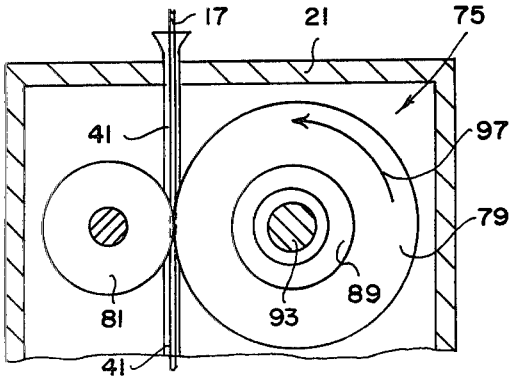
FIG. 6 is a view of detached structure intended to depict a portion of the wire feed drive means of the present invention.

The tool 11 also includes primary wire guide means 41 for establishing a channel through which the wire 17 may longitudinally be passed, i.e., from the spool 33 to the jaws 25, 27. From FIGS. 2A and 3A of the drawings it may clearly be seen that the tool 11 also includes unitary drive means generally indicated at 43. The unitary drive means 43 includes wire feed drive means, characterized by the numeral 45 as shown in FIGS. 2A, 3A, and 6 of the drawings, for properly feeding the wire 17 through the primary wire guide means 41, in a manner to be more fully disclosed as the specification proceeds.

The primary wire guide means 41 is tubular in cross section. Thus the wire 17 is free to pass longitudinally therethrough. The jaws 25, 27 are arcuately constructed so as to jointly establish bight-forming wire guide means 47. The latter means 47 are communicated with the primary wire guide means 41 for engaging and properly guiding the lower end of the wire 17 as it is also fed therethrough by the wire feed drive means 45. Thus, a bight portion of the wire is formed as shown in FIG. 4 of the drawings and characterized therein by the numeral 49. The bight 49 is circumposed about the pair of structural members 13, 15 as clearly shown therein.

Figures 1, 11, 12, 13, 14:
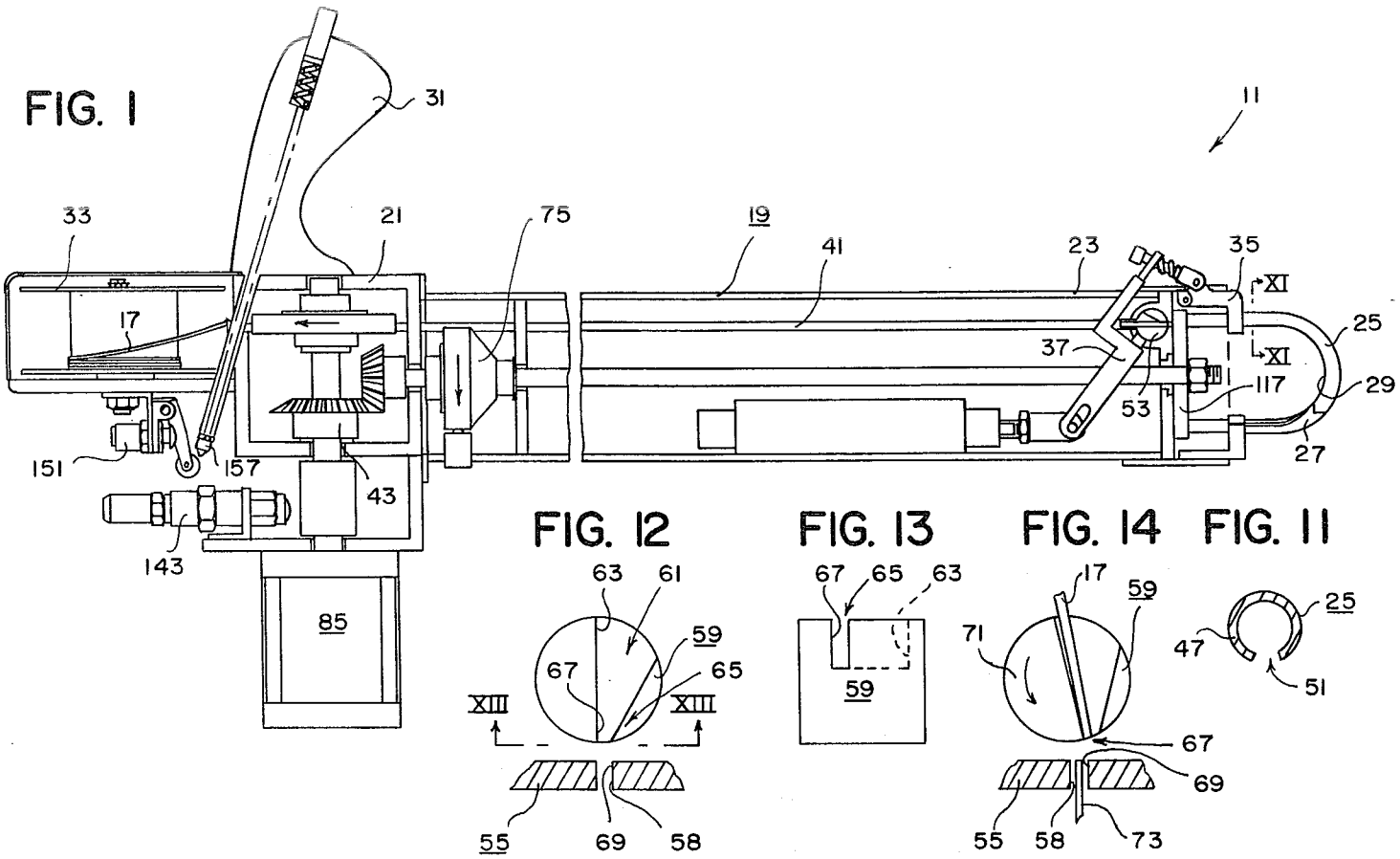
FIG. 1 is an elevational view of the wire binding tool of the present invention but which is shown in an abnormal condition, i.e., the jaws (while shown closed) are normally opened except during the operation thereof—during which time the tool, of course, is held with the major axis thereof being in a vertical position with the jaws being the lowermost portion thereof.
FIG. 11 is a sectional view taken as on the line XI—XI of FIG. 1.
FIG. 12 shows details of detached structure showing the wire shear means in the normal position.
FIG. 13 is a view taken as on the line XIII—XIII of FIG. 12.
FIG. 14 is a view similar to FIG. 12 showing the wire shear means in operation, i.e., shearing the wire.

From FIG. 11 of the drawings it may clearly be seen that the bight-forming wire guide means 47 is established by constructing the jaws 25, 27 from tubular structure. However, it should be observed that the tubular structure is provided with a slit, as at 51, which co-extends the lengths of the jaws 25, 27 and which is disposed along the innermost arcuate portions thereof.

Accordingly, the slit 51 readily provides means for enabling the jaws 25, 27 to move away from the bight portion of wire 49 when the jaws 25, 27 are moved to the open position, as shown in FIG. 3B of the drawings.

The tool 11 also includes wire shear means, as at 53, and generally shown at FIGS. 2B, 3B, 4 and 5 of the drawings. The wire shear means are interposed between the primary and bight-forming wire guide means 41, 47. From FIGS. 2B and 3B of the drawings, it may be seen that the tool 11 includes a plate-like member 55 which is fixedly attached to the lower end 23 of the main body in any well known manner, as by welding or the like. The wire shear means 53 includes a hollow cylinder-like member 57, which is preferably integrally attached to the plate-like member 55, thus establishing a relatively fixed member of the wire shear means 53, i.e., the fixed member or hollow cylinder-like portion 57 is provided with an aperture 58 through which the wire 17 freely passes prior to being introduced to the jaws 25, 27.

The wire shear means 53 also includes a rotatable member or a solid cylinder-like member, as at 59, which is rotatably received within the hollow cylinder-like portion 57. The rotatable member, or solid cylinder-like member 59, is provided with a cuneated transverse slot, as at 61, and best shown in FIGS. 12 and 14 of the drawings. The slot 61 tapers from a broad terminus 63 to a narrow terminus 65 and thusly establishes a shearing edge 67. A co-acting shearing edge 69 is established by the previously mentioned aperture 58 being provided in the plate-like member 55, i.e., the wire 17 passes first through the slot 61 then is received within the aperture 58 prior to moving on to the jaws 25, 27. From FIG. 14 of the drawings it may clearly be seen that the wire 17 is sheared by the shearing edges 67, 69, as the cylinder-like member 59 is rotated counter-clockwise as viewed therein and as suggested by the arrow 71. Of course, even though FIGS. 12 and 14 might suggest otherwise, the plate-like member 55 (having the aperture 58 provided therein) and the rotatable member 59 are disposed in close proximity one with the other. Thus, the bight-portion of wire 49 is severed from the wire 17 or it may also be said that a work piece, as at 73, is established from the wire 17. More specifically, the ultimate configuration of the work piece 73 is shown in FIG. 5 of the drawing, although the initial shape of the work piece 73 is substantially identical to the bight portion 49 of wire 17 as shown in FIG. 4 of the drawings.

The unitary drive means 43 alluded to above also includes wire twist drive means, as generally indicated at 75 in FIG. 1 of the drawings, for engaging and twisting the remote ends 73', 73'' of the work piece 73 to form a closed loop, as at 77, around the pair of structural members 13, 15, thus effectively binding them together.

The wire feed drive means 45 alluded to above includes a drive wheel 79 tangentially disposed against a free-turning wheel 81 in a manner as best shown in FIG. 6 of the drawings. Thus, the wire 17 may be urged to move along the length thereof, since it is sandwiched between the wheels 79, 81, as will be fully described below.

Figure 10:
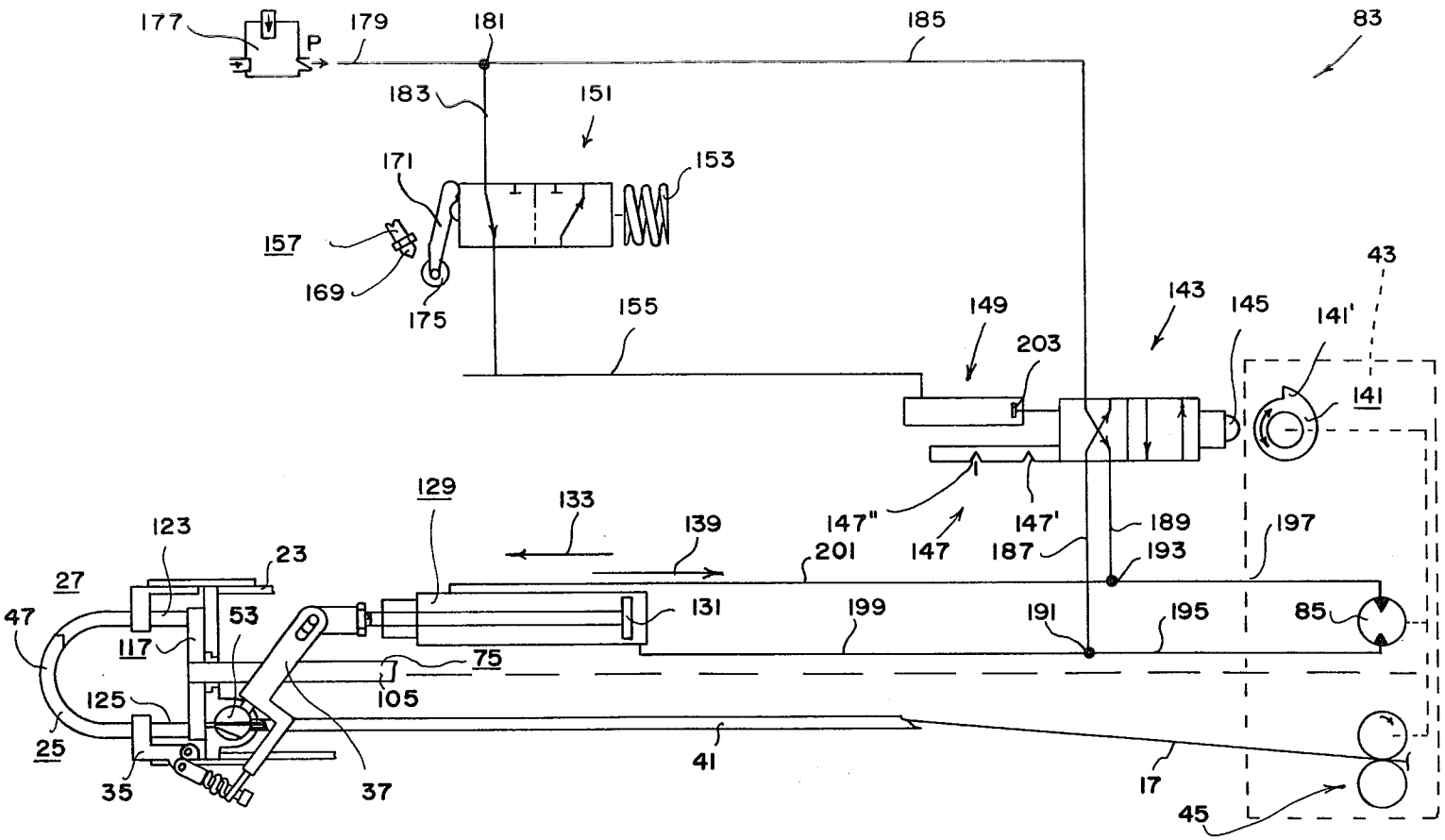
FIG. 10 is a schematic which diagrammatically depicts the operative structure of the present invention.

From FIG. 10 of the drawings, it may be seen that the tool 11 includes pneumatic actuatable means generally indicated by the numeral 83 for operating the unitary drive means 43 and the jaw operating means or lever arrangement 37, in a manner which will be fully disclosed as the specification proceeds.

From FIGS. 1–3 and 10 of the drawings, it may readily be seen that the unitary drive means 43 includes a rotary actuator 85, well known to those skilled in the art, capable of selectively being actuated in either a forward or reverse direction through predetermined degrees of rotation, e.g., substantially 270°.

The unitary drive means alluded to above includes selective drive means, generally indicated at 87 in FIGS. 2A and 3A of the drawings, for automatically placing the wire feed drive means 45 into operation while simultaneously placing the wire twist drive means 75 into a stand-by condition as the rotary actuator 85 is rotated in the forward direction and, conversely, for automatically placing the wire twist drive means 75 into operation while simultaneously placing the wire feed drive means 45 into a standby condition, as the rotary actuator 85 is rotated in the reverse direction thereof, in a manner to be more fully disclosed below.

The selective drive means 87 alluded to above includes a pair of ratchet-like coupler means 89, 91, of a construction well known to those skilled in the art, respectively introduced to the wire feed drive means 45 and the wire twist drive means 75. The ratchet-like couplers 89, 91, being operable in a manner well known to those skilled in the art, are arranged for alternately engaging the wire feed drive means 45 and the wire twist drive means 75 with the rotary actuator 85, i.e., respectively commensurate with the above mentioned forward and reverse direction of rotation thereof.

More specifically, the selective drive means 87 includes a main drive shaft, as at 93, which is journaled to the main body member 19 in any well known manner as with sleeve bearings 94 or the like. The shaft 93 is directly coupled to the rotary actuator 85 for direct forward and reverse directions of rotation therewith, as clearly shown in FIGS. 2A and 3A of the drawings. However, since the ratchet-like coupler 89 is interposed between the driven wheel 79 of the wire twist means 75 and the shaft 93, the wheel 79 may only be rotatably driven in the direction of an arrow 97, as shown in FIGS. 2A, 3A, and 6 of the drawings, i.e., as the shaft 93 is rotated in the same direction. Therefore, rotation of the shaft 93 in a direction opposite the arrow 97 will not cause rotation of the driven wheel 79, since the ratchet-like coupler means 89 is brought into play, thus precluding such rotation thereof. Accordingly, it may be concluded that the driven wheel 79 may only be rotated in the direction of the arrow 97 irrespective of the direction of rotation of the rotary actuator 85 and/or shaft 93.

In view of the above, it should now be apparent (when viewing FIG. 6) that the process of feeding the wire 17 downwardly through the wire-guide means 41 is limited to one direction of rotation of the main drive shaft 93, i.e., in the forward direction as the arrow 97 depicts.

The selective drive means 87 also includes first and second bevel gears 95, 99 as best shown in FIGS. 2A and 3A of the drawings. The first bevel gear 95 is affixed to the main drive shaft 93 for rotation therwith. The second bevel gear 99, is arranged to meshingly engage the first bevel gear 95 so as to rotate therewith. The second bevel gear 99 is affixed to an auxiliary drive shaft 101, which is journaled to the main body member 19 in any well known manner, as with a sleeve bearing 103 or the like.

Figure 7:
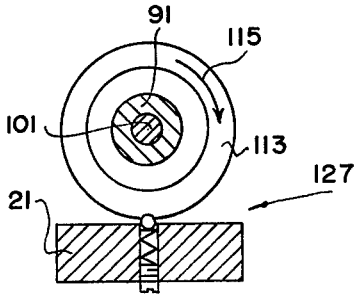
FIG. 7 shows detached structure which includes ball detent means for yieldably holding the wire twist means in a normal position to facilitate feeding the wire into the jaws.

The selective drive means 87 also includes a unidirectional rotatable shaft 105 which is journaled at either end thereof to the main body member 19 by a pair of sleeve bearings 107, 109. The sleeve bearing 107 is supported by the previously mentioned plate-like member 55, while the sleeve bearing 109 is supported by a plate-like member 111. Fixedly attached to one end of the unidirectional rotatable shaft 105 is a conical shaped fly wheel 113 which facilitates adapting the ratchet-like coupler means 91 to the auxiliary drive shaft 101. This adaptation is in such a manner that irrespective of the direction of rotation of the auxiliary drive shaft 101, the conical shaped fly wheel 113 and/or the unidirectional rotatable shaft 105 will only turn in one direction, i.e., in the reverse direction as indicated by an arrow 115 (FIGS. 2A, 3A and 7).

In view of the above disclosure, it can readily be concluded that rotation of the rotary actuator 85 in one direction or forward as shown by the arrow 97 is effective in feeding wire 17 through the wire guide means 41, 47, while rotation of the rotary acutator 85 in the opposite direction or reverse as shown by the arrow 115 is effective in rotating the shaft 105 in the direction of the arrow 115, the effect of which is about to be disclosed.

From FIGS. 2–5 of the drawings, it may be seen that the wire twist drive means 75 includes wire engagement means, as at 117, for receiving and yieldably holding the remote ends of the work piece 73, as the wire twist drive means 75 is being rotated by the unitary drive means 43. The wire engagement means 117 preferably includes a disk-like member 119, which is affixed to one end of the unidirectional rotatable shaft 105, as with a nut 121 or the like, for rotation therewith. The wire engagement means 117 also includes a pair of tubular members 123, 125, for receiving the remote ends 73', 73" of the work piece 73.

Therefore, it may readily be seen that the wire engagement means 117 engages and twists the remote ends 73', 73" of the work piece 73 to form the closed loop 77 around the pair of structural members 13, 15, thus effectively binding them together as the wire engagement means 117 is rotatably driven by the wire twist drive means 75 in the direction of the arrow 115, as shown in FIG. 5 of the drawings. The manner in which the work piece pulls free from the jaws 25, 27 was suggested previously when describing the slit 51 (FIG. 11).

The tool 11 also includes means, e.g., ball detent means 127, as shown in FIGS. 2A, 3A, and 7 of the drawings, for assuring optimum alignment of the wire engagement means 117 with the bight-forming wire guide means 47 subsequent to the operation of the wire twist drive means 75. The ball detent means 127 is incorporated with the conical shaped fly wheel 113, i.e., since the fly wheel 113 and the disk-like member 119 rotate in unison, in the direction of the arrow 115. Thus, the ball detent means 127 assures that the fly wheel 113 comes to rest in precisely the right position to facilitate feeding the wire 17 from the primary wire guide means 41 into the bight forming wire guide means 47. It will be appreciated that since the structure of the ball detent means 127 is considered mundane, no attempt will herein be made to elaborate further thereon.

From FIGS. 2B, 3B and 10 of the drawings, it may readily be seen that the pneumatic actuatable means 83 includes double acting air cylinder actuator means 129, which may hereinafter simply be referred to as cylinder means. The cylinder means 129 is arranged for simultaneously operating the jaw operating means or lever arrangement 37 as well as the wire shear means 53. The pivotal jaw 25 as previously mentioned, is normally in the "open position" as shown in FIG. 3B of the drawings.

Therefore, it can be seen that operation of the cylinder means 129, or movement of a piston member 131, in the direction of an arrow 133 is effective in causing the wire shear means 53 to sever the wire 17, thus establishing the work piece 73 therefrom. Of course, it should be mentioned that the lever arrangement or jaw operating means 37 includes a primary lever member 135 which is suitably attached to the rotatable cylinder-like member 59, i.e., by incorporating coupling apparatus, as at 137. In other words, the coupling apparatus 137 suitably joins the rotatable member 59 with the primary lever member 135, whereby movement of the jaw 25 is also effective in causing rotation of the rotatable member 59, in a manner more fully disclosed below.

The primary lever member 135 is suitably coupled to the cylinder means 129, in a manner substantially as shown in FIGS. 2B and 3B of the drawings. The jaw operating means 37 includes linkage as at 140 for coupling the primary lever means 135 to the pivotal jaw 25 so as to cause the pivotal jaw 25 to move to the "open position", as shown in FIG. 3B, i.e., as the piston 131 (FIG. 10) is moved in the direction of the arrow 133.

In view of the above disclosure, it can now readily be seen that operation of the cylinder means 129 or the piston 131 in a first direction, i.e., in the direction of the arrow 133 in FIG. 10, is effective in simultaneously causing the wire shear means 53 to sever the wire 17 and in causing the jaw operating means or lever arrangement 37 to move the pivotal jaw 25 to the open position. On the other hand, operation of the cylinder means 129 or the piston 131 in a second direction (as indicated by an arrow 139 in FIG. 10) is effective in returning the wire shear means 53 to a "standby condition" and simultaneously moving the pivotal jaw 25 to the "closed position" as shown in FIGS. 2B and 10 of the drawings.

From FIGS. 1–3 and 8–10 of the drawings, it may be seen that the tool 11 includes a cam member 141, which is coupled to the rotary actuator 85 for movement therewith to and fro about an arcuate path. More specifically, the cam member 141 is affixed to the main drive shaft 93, which of course rotates in either direction as determined by the rotary actuator 85, as previously described.

The pneumatic actuator means 83 includes a two-position four-way valve 143, as best shown in FIG. 10 of the drawings and which has "first" and "second control positions", i.e., the valve 143 is shown in FIG. 10 in the "second position", and it would be moved to the left (FIG. 10) when in the "first position". The rotary actuator 85 is responsive to either of the two control positions of the valve 143, whereby the "first position" thereof is effective in causing the rotary actuator 85 to rotate in its forward direction while the second position thereof is effective in causing the rotary actuator 85 to rotate in its reverse direction. In other words, the cam 141 is arranged in a manner described below so as to rotate forward or clockwise when the valve 143 is in its first position and to rotate counter-clockwise when the valve 143 is in the position shown or second position thereof.

The valve 143 is of a construction well known to those skilled in the art and includes a cam follower 145 arranged for timed engagement with the cam member 141 subsequent to the rotary actuator 85 having rotated through a predetermined number of degrees of rotation, e.g., 270°, with such engagement being effective in moving the valve 143 to the "first control position" thereof (or to the left, as shown in FIG. 10), thus causing the rotary actuator 85 to rotate in the reverse direction thereof, in a manner to be fully disclosed as the specification proceeds.

Figure 8:
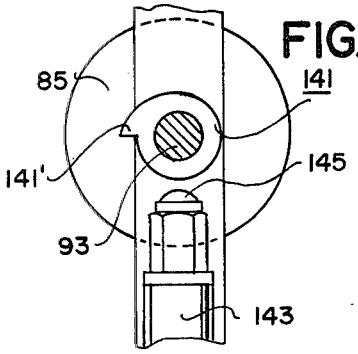
FIG. 8 shows detached structure intended to depict a cam in a normal position which corresponds with FIG. 4.
Figure 9:
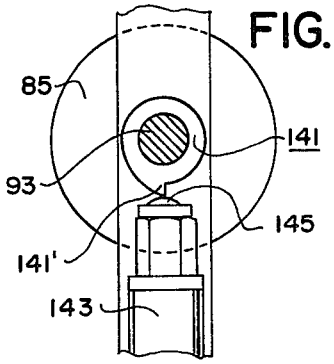
FIG. 9 is a view similar to FIG. 8 except the cam is shown displaced 270°, thus twisting the wire so as to form the loop as shown in FIG. 5.

Of course, the valve 143 or merely the valve body is also shown in FIGS. 1–3 and 8 and 9 of the drawings while FIGS. 8 and 9 of the drawings are intended to show the specific relationship of the cam member 141 with the valve 143. In order to gain a complete understanding of this disclosure it should be recognized that the rotary actuator 85, hence the cam member 141, inherently reach the limits of travel when the cam member 141 is in the poition as shown in FIG. 8, i.e., a lobe, as at 141', being shown in its maximum counter-clockwise or reverse direction of travel. In other words, the design structure of the rotary actuator 85 is such that it reaches its physical limits of travel at this point. FIG. 9 is intended to depict the position at which the cam member 141 engages the cam follower 145 so as to physically move the valve 143 to its first position, i.e., the effects of which will be fully disclosed below. Therefore, it should be sufficient to simply say at this point that the lobe 141' is shown in FIG. 9 in its maximum clockwise or forward direction of travel.

In order to get a better understanding of the nature of the valve 143, it should be realized that it is not biased toward either of the two positions thereof, i.e., it will assume either of the two control positions when suitably acted upon. Therefore, the valve 143 includes a detent arrangement, as at 147, which is intended to simply stabilize the valve 143 in either of the two control positions. More specifically, the detent arrangement 147 includes a first detent 147' and a second detent 147'' which respectively correspond to the previously mentioned "first" and "second positions" of the valve 143, i.e., the detent arrangement 147 is shown in FIG. 10 in the second detent 147'', thus the valve 143 is in the "second position" thereof.

In addition, the valve 143 includes a pneumatic actuatable cylinder 149 which is intended to merely move the valve 143 from the "first position" to the "second position" thereof in a manner to be fully disclosed below.

The pneumatic actuatable means 83 includes a two-position pilot valve, as at 151, in FIGS. 1–3 and 10 of the drawings, which has an "operation position" and a "dump position" and is shown in FIG. 10 in the "operation position" thereof. A compression spring 153 or the like (FIG. 10) yieldably biases the pilot valve 151 toward the "dump position" thereof. A conduit 155 communicates the pilot valve 151 with the four-way valve 143. The valve 143 is responsive, at least in part, to the pilot valve 151 or to the extent that placing the pilot valve 151 in the "operation position" thereof (as shown) is effective in causing the four-way valve 143 to be moved to the "second control position" thereof (as shown). Although the position of the four-way valve 143 is not influenced by returning the pilot valve 151 to the "dump position" thereof, i.e., this will be more fully disclosed below.

From FIGS. 1–3 and 10 of the drawings, it may readily be seen that the tool 11 includes manually operable mechanical trigger means, as at 157. The trigger means 157 includes a trigger member 159 conveniently fitted to the handle 31 for thumb engagement thereof. The trigger member 159 is yieldably biased upwardly as shown in FIG. 2A by a compression spring 161 or the like. Thus, the trigger member 159 may be manually operable to the position as shown in FIG. 3A or to the "operation position" thereof. The manual trigger means 157 also includes a push rod 163, which is slidably attached to the main body member 19 by being received in a tubular arrangement 165. A distal end 167 of the push rod 163 is conveniently fitted with a conical shaped member 169. The trigger means 157 also includes a pivot arm 171 conveniently attached to the main body member 19 for pivotal movement about a pivot pin 173. The lower end (as shown) of the pivot arm 171 is conveniently fitted with a roller 175 arranged for engagement with the conical shaped member 169, i.e., engagement of the conical shaped member 169 with the roller 175, as shown in FIG. 3A, is effective in moving the pilot valve 151 to the "operation position" thereof, the position as shown in FIG. 10 of the drawings.

Stated another way, the trigger means 157 is arranged for operable engagement with the pilot valve 151, whereby operation of the trigger means 157 is effective in initiating a pre-arranged sequence of events, all of which are predicated upon moving the two-position four-way valve 143 from the "first position" thereof to the "second position" thereof.

OPERATION DISCLOSURE

From the above disclosure it can now be appreciated that operation of the tool 11 is accomplished in the following manner:

1. The workman manually positions the open jaws 25, 27 around the rods 13, 15.

2. He then depresses the trigger member 159 which automatically accomplishes several important steps as follows:

(a) The cylinder means 129 is actuated which, of course, closes the jaws 25, 27.

(b) The rotary actuator 85 is caused to rotate in the forward direction, i.e., driving the cam member 141 from the position shown in FIG. 8 to the position shown in FIG. 9.

(c) The wire feed drive means 45 is actuated, which feeds the wire 17 into the bight-forming wire guide means 47.

(d) Subsequent to 270° rotation of the rotary actuator 85 and the cam member 141 which, of course, engages the lobe 141' with the valve 143, the following steps are accomplished:

(1) The action of the cylinder means 129 is reversed, which opens the jaws 25, 27 to the position shown in FIG. 3B.

(2) The wire shear means 53 is actuated which established the work piece 49, as shown in FIG. 4.

(3) The wire twist drive means 75 is actuated, which forms the loop 77 around the structural rods 13, 15, as shown in FIG. 5, and, (4) The rotary actuator 85 is caused to rotate in the reverse direction (or counter-clockwise as shown in FIG. 9) so as to return to the position shown in FIG. 8.

3. Finally, the workman removes the tool 11 and repositions it for the next cycle of operation. The time for each cycle is only a few seconds. Therefore, many wire ties can easily be made in less than one minute.

SCHEMATIC DISCLOSURE

Particular attention is now directed toward FIG. 10 of the drawings for the purpose of more fully explaining the operative structure of the pneumatic actuator means 83. A pneumatic pump 177 delivers air under pressure to a main conduit 179, which branches at a Tee connection 181 to a pair of conduits 183, 185. One end of the conduit 183 is connected to the Tee connection 181, while the other end thereof is connected to the pilot valve 151. One end of the conduit 185 is connected to the Tee connection 181, while the other end thereof is connected to the four-way valve 143.

A pair of conduits 187, 189 lead outwardly from the valve 143. One end of the conduit 187 is connected to the valve 143, while the other end thereof is connected to a Tee connection 191. One end of the conduit 189 is connected to the valve 143, while the other end thereof is connected to a Tee connection 193. A pair of conduits 195, 197 respectively interconnect opposite sides of the rotary actuator 85 with the Tee connections 191, 193.

A pair of conduits 199, 201 respectively interconnect opposite sides of the cylinder means 129 with the Tee connections 191, 193. The pneumatic actuatable cylinder 149 includes a piston member 203, which is suitably attached to the valve structure 143 so that movement of the piston 203 to the right, as shown in FIG. 10, is effective in moving the valve 143 from the first position thereof to the second position thereof or the right as shown.

Accordingly, it may readily be seen that operation of the pump 177 immediately places air pressure in the conduits 179, 183, 185. Momentary operation of the trigger means 157 moves the valve 151 to the right (as shown) or to the "operation position" thereof. However, the spring 153 is effective in returning the valve 151 to the "dump position" or condition thereof. Thus, the momentary operation position of the valve 151 is effective in momentarily placing air pressure within the conduit 155. This, of course, results in the piston 203 being moved to the right (as shown). Thus, the valve 143 is moved from the "first position" thereof to the "second position" thereof (as shown). Thus, pressurized air is simultaneously delivered to the conduits 189, 197, and 201, which, of course, moves the piston 131 of the cylinder means 129 to the right, as shown, or it moves in the direction of the arrow 139, as previously mentioned. In addition, the rotary actuator 85 or the cam 141 is caused to rotate in a clockwise direction.

As the piston 131 moves to the right, the jaws 25, 27 were moved to the "closed position". In addition, the wire shear means 53 were rotated to the position shown, thus establishing a clear channel for the wire 17 to move from the primary wire guide means 41 into the jaws 25, 27 or into the bight-forming wire guide means 47. At this same time, the wire feed drive means 45 are actuated, which move the wire 17 into the bight-forming wire guide means 47. The 270° rotation of the cam member 141, i.e., to the position as shown in FIG. 9, is effective in moving the valve 143 to the left or engaging the detent 147'. Of course, the piston 203 may readily be moved to the left, since there is no longer any pressure in the conduit 155, i.e., the pressure dumps immediately (through the right side of the valve 15) when the trigger means 157 was released.

Movement of the valve 143 to the left is, of course, effective in placing pressurized air in the conduits 187, 195, 199. This immediately causes the piston 131 of the cylinder means 129 to move to the left, or in the direction of the arrow 133, since the air pressure within the conduits 201, 189 may readily be dumped through the right side of the valve 143. Of course, the same can be said for the conduit 197, which allows the rotary actuator 85 to rotate counter-clockwise 270°, i.e., until it reaches its maximum limit of travel.

Movement of the piston 131 to the left is effective in actuating the wire shear means 53, thus shearing the wire 17 and forming the work piece 49. In addition, the jaws 25, 27 are moved to the "open position". At the same time, the counter-clockwise rotation of the rotary actuator 85 causes the wire twist drive means 75 to come into play, which rotatably drives the wire engagement means 117 to form the loop 77 about the reinforcement rods 13, 15. The workman may then simply lift the tool 11 free from the rod 13, 15 to commence the next cycle of operation thereof.

Although the invention has been described and illustrated with respect to a preferred embodiment thereof, it should be understood that it is not intended to be so limited, since changes and modifications may be made therein which are within the full intended scope of the invention.

We claim:

1. A tool for binding a pair of juxtapose elongate structural members together by utilizing a supply of wire said tool comprising a main body member having upper and lower ends thereto, a pair of jaws disposed adjacent the lower end of said main body member and defining in part a hole through which the pair of structural members may freely extend, at least one of said pair of jaws being pivotally mounted to said body member, jaw operating means coupled to the pivotal jaw(s) for remotely operating said pivotal jaw between a "closed position" and a normally "open position" wherein a mouth-like opening is established for enabling the open jaws to be passed over the pair of juxtaposed structural members and thus being admitted to the hole, wire guide means for establishing a channel through which the wire may longitudinally be passed, means for feeding the wire through said wire guide means, wire shear means for shearing the wire, means for twisting the wire around the pair of juxtaposed structural members, and rotary actuator means operable in a forward and reverse rotational direction for operating said wire feeding means to feed wire through said guide means when rotating in a forward direction, and operating said wire twisting means to twist the wire around the pair of juxtaposed structural members when rotating in a reverse direction.

2. The tool as set forth in claim 1 further comprising pneumatic actuatable means for operating said rotary actuator means and said jaw operating means.

3. The tool as set forth in claim 2 in which said rotary actuator means includes selective drive means for automatically placing said wire feeding means into operation while simultaneously placing said wire twisting means into a standby cndition when said rotary actuator means is rotated in a forward direction, and conversely for automatically placing said wire twisting means into operation while simultaneously placing said wire feeding means into a standby condition when said rotary actuator means is rotated in a reverse direction.

4. The tool as set forth in claim 3 in which said selective drive means includes a pair of ratchet-like coupler means respectively introduced to said wire feeding means and said wire twisting means with said pair of ratchet-like coupler means being arranged for alternately engaging said wire feeding means and said wire twisting means with said rotary actuator means commensurate with the forward and reverse directions of rotation thereof.

5. The tool as set forth in claim 2 wherein said pneumatic actuatable means comprises double acting air cylinder actuator means arranged for simultaneously operating said jaw operating means and said wire shear means, said pivotal jaw normally being in the "open position" thereof, operation of said double acting air cylinder actuator means in a first direction is effective in simultaneously causing said wire shear means to sever the wire and causing said jaw operating means to move said pivotal jaw to the "open position" thereof, while operation of said double acting air cylinder actuator means in a second direction is effective in simultaneously returning said wire shear means to a "stand-by condition" and moving said pivotal jaw to the "closed position" thereof.

6. The tool as set forth in claim 1 in which said wire twisting means includes wire engagement means for receiving and yieldably holding the remote ends of said wire as said wire twisting means is being rotated by said rotary actuator means.

7. The tool as set forth in claim 6 further comprising means for assuring optimum alignment of said wire engagement means with said wire guide means subsequent to the operation of said wire twisting means.

8. A tool for binding a pair of concrete reinforcement rod structural members together by utilizing a supply of wire that is provided in a continuous form, said tool comprising an upright main body member having upper and lower ends thereto, a pair of jaws disposed adjacent the lower end of said main body member and defining in part a hole through which a pair of structural members may freely extend, means for pivotally attaching at least one of said jaws to said main body member, jaw operating means coupled to the pivotal jaw for operating said pivotal jaw between a closed position and normally open position wherein a mouth-like opening is established for enabling the open jaw to be passed over the medial portions of the structural members and thus being admitted to the hole, wire guide means for establishing a channel through which the wire may longitudinally pass, unitary drive means for feeding the wire through said wire guide means, and wire shear means for shearing wire, said unitary drive means including means for engaging and twisting the wire around the pair of structural members, a rotary actuator capable of selectively being actuated in either a forward or reverse direction through predetermined degrees of rotation, and pneumatic actuator means for operating said unitary drive means and said jaw operating means, said pneumatic actuator means including a two-position-four-way valve having "first" and "second control positions", said rotary actuator being responsive to either of the two control positions of said two-position-four-way valve whereby the first position thereof is effective in causing said rotary actuator to rotate in the forward direction while the "second position" thereof is effective in causing said rotary actuator to rotate in the reverse direction.

9. The tool as set forth in claim 8 in which is included a cam member coupled to said rotary actuator for movement therewith to and fro about an arcuate path, and in which said two-position-four-way valve includes a cam follower arranged for timed engagement with said cam member subsequent to said rotary actuator having rotated through a predetermined number of degrees of rotation with such engagement being effective in moving said two-position-four-way valve to the "first control position" thereof, thus causing said rotary actuator to rotate in the reverse direction thereof.

10. The tool as set forth in claim 9 in which said pneumatic actuatable means includes a two-position pilot valve having an "operation position" and a "dump position", said two-position pilot valve being yieldably biased toward the "dump position" thereof and being communicated with said two-position-four-way valve—with the latter being responsive at least in part to said pilot valve to the extent that placing said pilot valve in said "operation position" is effective in causing said two-position-four-way valve to be moved to the "second control" position thereof, although returning said pilot valve to the dump position thereof does not influence the positioning of said two-position-four-way valve.

11. The tool as set forth in claim 10 in which is included manually operable mechanical trigger means for momentarily moving said two-position pilot valve to the "operation position" thereof, said trigger means being arranged for operable engagement with said pilot valve whereby operation of said trigger means is effective in initiating a pre-arranged sequence of events all of which are predicated upon moving said two-position-four-way valve from the "first position" thereof to the "second position" thereof.

* * * * *